US005495815A

United States Patent [19]

Bagnall

[11] Patent Number: 5,495,815

[45] Date of Patent: Mar. 5, 1996

[54] TUFTING MACHINE HOOK DRIVE

[75] Inventor: Arthur F. Bagnall, Manchester, BG2

[73] Assignee: Spencer Wright Industries, Inc., Dalton, Ga.

[21] Appl. No.: 450,721

[22] Filed: May 25, 1995

[51] Int. Cl.[6] ..... D05C 15/22

[52] U.S. Cl. ..... 112/80.5; 112/80.55

[58] Field of Search ..... 112/80.5, 80.51, 112/80.52, 80.53, 80.54, 80.55, 80.56, 80.57, 80.58, 80.59, 80.6, 165, 166, 167, 199

[56] References Cited

U.S. PATENT DOCUMENTS 3,973,505 8/1976 Prichard .
4,134,347 1/1979 Jolley et al. .
4,834,005 5/1989 Bagnall .
4,860,674 8/1989 Slattery ..... 112/80.55 X

*Primary Examiner*—Paul C. Lewis
*Attorney, Agent, or Firm*—Alan Ruderman

[57] ABSTRACT

A tufting machine has a hook bar for mounting a plurality of hooks and is secured to a plurality of drive links driven by oscillating rocker arms from a rock shaft, and includes a plurality of resilient leaf springs secured at spaced apart locations to the hook bar and to a fixed member in the bed of the tufting machine. The leaf springs provide a low oscillating mass support for the hook bar in the plane of oscillation. Tension tie-rods extend laterally between adjacent drive links to counteract the lateral loads of the knives against the hooks.

14 Claims, 3 Drawing Sheets

TUFTING MACHINE HOOK DRIVE

BACKGROUND OF THE INVENTION

This invention relates to tufting machines and more particularly to a hook driving assembly for cut pile tufting machines.

Tufting machines incorporate a multiplicity of yarn carrying needles which reciprocate cyclically to penetrate a backing material and cooperate with a multiplicity of loopers or hooks to form loop pile or cut pile respectively in the backing material. In a cut pile tufting machine the loops which are formed by the cooperation of the individual needles and hooks are severed on the hooks to provide cut pile. The means for severing the loops comprise a knife that acts against the lower edge of the loop-penetrating blade of the respective hook adjacent the throat or neck of the hook remote from the bill.

The hooks are driven to oscillate in a path having forward and backward motion for seizing a loop from the respective needles. The knives are mounted on an oscillating shaft to oscillate relative to the hooks. In a conventional construction, the hook mounting bar is mounted to pivot about a remote axis by an arm of significant length, the arm being curved so as to extend around the knife drive shaft which is positioned below the hook bar. Motion of the hook bar is derived from a hook drive shaft which, through an eccentric and drive linkage, oscillates the hook bar about the remote pivot. Examples of such a drive mechanism are illustrated in U.S. Pat. Nos. 3,973,505 (Pritchard); 4,134,347 (Jolley et al) and 4,834,005 (Bagnall).

The long rocker arm in the aforesaid construction in addition to providing the required oscillating path to the hooks also aids in supporting the hooks and, because of its rigidity, provides support for the lateral forces applied by the knives against the hooks. However, the system because of the extremely long and rigid arm has a very high oscillating mass. Such an oscillating mass even when effectively balanced to a large degree, as in the aforesaid Pritchard patent, has a limiting effect on the speed at which the tufting machine may operate.

SUMMARY OF THE INVENTION

Consequently, it is a primary object of the present invention to provide a low mass hook driving system for a cut pile tufting machine.

It is another object of the present invention to provide a tufting machine having a hook driving system wherein the motion of the hook bar is guided or directed by a resilient member, the resilient member being secured to the hook bar at one end and fixed in the bed at a remote end.

It is a further object of the present invention to provide a cut pile tufting machine having a hook driving system wherein a low mass member supports and guides the movement of the hook bar, the hook bar motion being derived from an oscillating drive link, and the lateral forces exerted by the knives against the hooks are reacted by tension tie-rods extending between adjacent drive links.

Accordingly, the present invention provides a hook driving construction for a cut pile tufting machine wherein the oscillating mass is substantially reduced, whereby the speed of the tufting machine may be increased without accompanying unacceptable vibrational levels. To this end the present invention provides a hook bar for mounting a plurality of hooks, the hook bar being secured to a plurality of drive links driven by respective oscillating rocker arms from an oscillating or rock shaft extending normal to the plane of oscillation of the hook bar, a plurality of resilient members being secured at spaced apart locations to the hook bar and to support means in the bed of the tufting machine so as to provide support for the hook bar in the plane of oscillation of the hook bar. Tension or tie-rods extend laterally between adjacent drive links to counteract the lateral loads placed on the hooks by the respective knives and provide rigidity to the system. In the preferred form of the invention the resilient members are leaf springs fastened at respective ends to the hook bar and to a portion of the bed of the tufting machine and disposed so as to be spaced from the drive shaft for the knives. The tension rods extend at an inclined disposition between the adjacent links and the tension arm or rods may be adjustable selectively.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
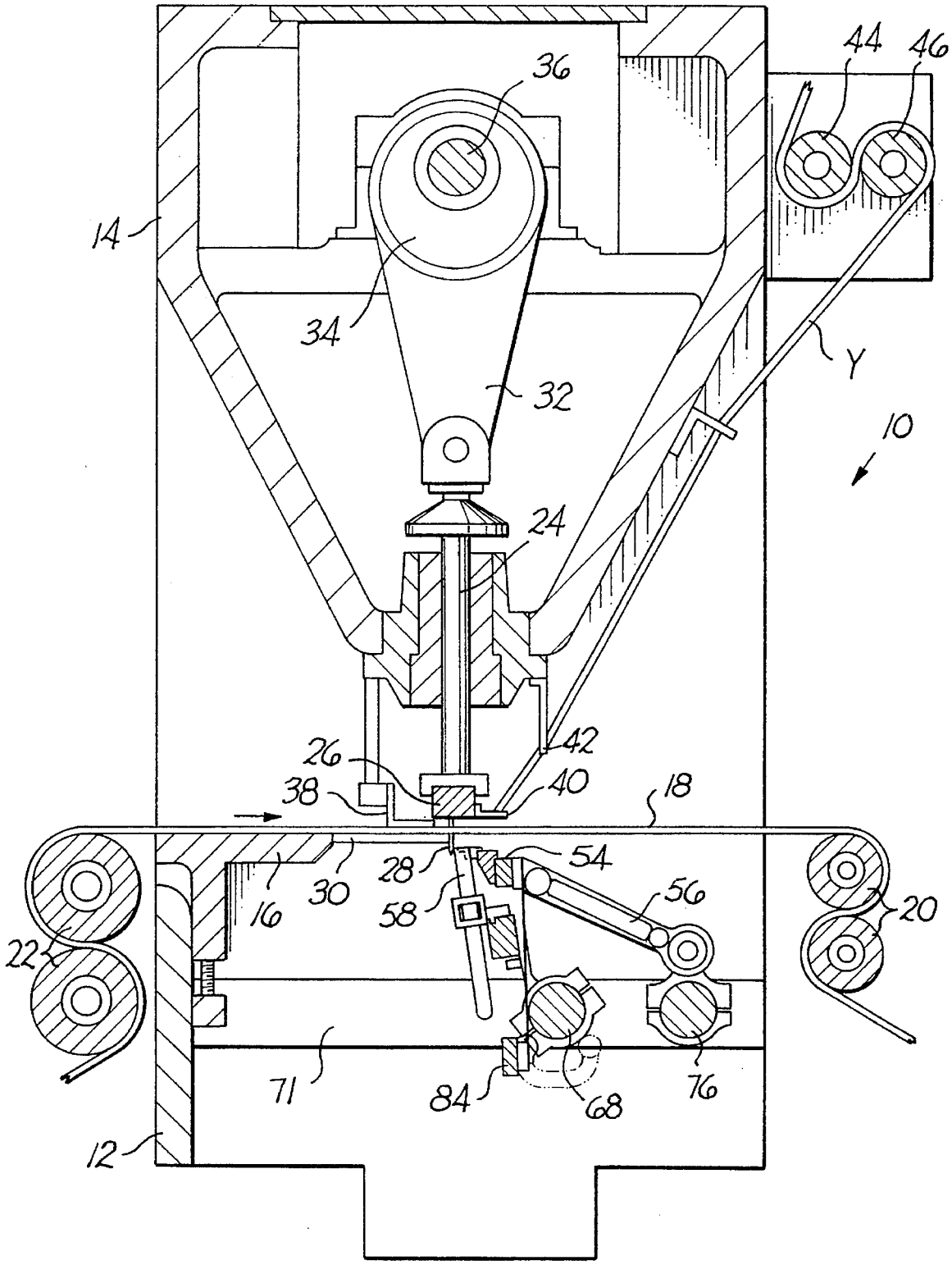
FIG. 1 is a vertical cross sectional view taken through a cut pile tufting machine incorporating a hook drive system constructed in accordance with the principles of the present invention.
Figure 2:
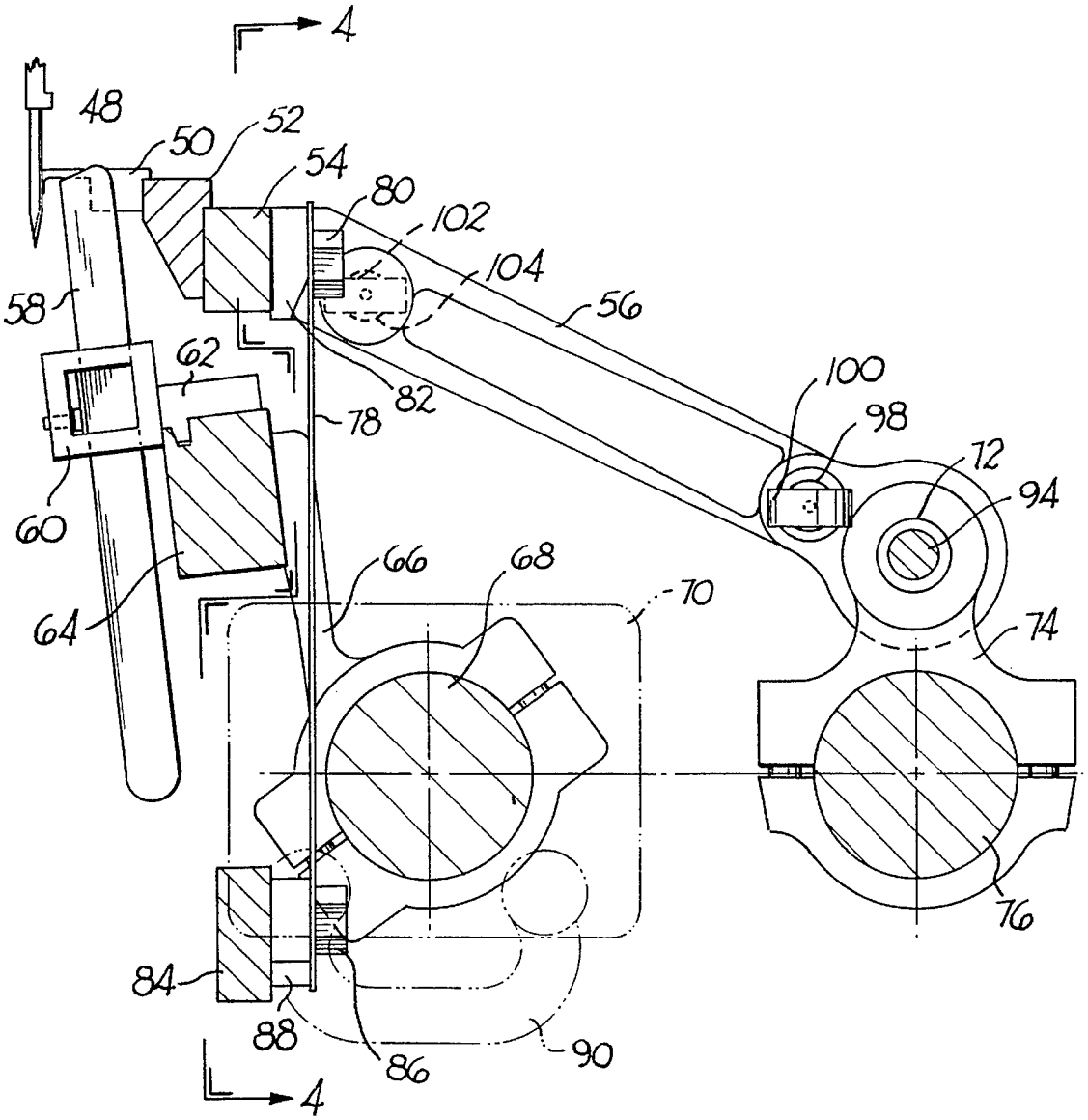
FIG. 2 is an enlarged cross sectional view of the hook drive system illustrated in FIG. 1.

Referring now to the drawings, FIG. 1 illustrates a tufting machine 10 having a frame comprising a bed 12 and a head 14 disposed above the bed. The bed 12 includes a bed plate 16 across which a backing material 18 is adapted to be fed by a pair of feed rolls 20 and take-off rolls 22.

Mounted in the head for vertical reciprocation is one of a plurality of push rods 24 to the lower end of which a needle bar 26 is carried and which in turn carries a plurality of needles 28, only one of which is illustrated, that are adapted to penetrate the backing material 18 through needle plate fingers 30 on the bed plate 16 upon reciprocation of the needle bar 26 to project loops of yarn Y therethrough. Endwise reciprocation is imparted to the push rods 24 and thus the needle bar 26 and needles 28 by a link 32 which is pivotally connected at its lower end to the push rods 24 and at its upper end to an eccentric 34 on a driven rotary main shaft 36 journalled longitudinally in the head 14, there generally being a number of such links 32 and eccentrics 34 spaced laterally in the head. A presser foot assembly 38 may be supported from the head 14 to hold down the base material 18 during needle retraction. A yarn-jerker 40 may be carried by the needle bar 26 to engage the yarn between a stationary yarn guide 42 on the frame of the machine and the needles 28. The yarn Y is supplied to each needle 28 by any convenient type of yarn feed mechanism such as feed rolls 44 and 46 to continuously feed yarn to the needles. The tufting machine thus far described is conventional and any of the structure described may be replaced by other conventional structure commonly used in the tufting art.

Mounted within the bed 12 for cooperation with the needles to seize loops of yarn presented by respective needles is a plurality of hooks 48, there being one hook for each needle. The hooks include a bill which points in the direction opposite of that in which the fabric is fed, as is conventional with cut pile tufting machines. The hooks have mounting portions 50 which are mounted within hook blocks 52, the hook blocks preferably being in modular form with each module carrying a plurality of hooks. The hook blocks 52 are secured to a hook mounting bar 54 fastened to one end of a plurality of links 56 spaced apart laterally in the bed as hereinafter further described.

Mounted so as to cooperate with the hooks are a plurality of knives 58, there being one knife for each hook. The knives are mounted within a plurality of knife blocks 60, each knife block, which may be modular in form, carrying a number of knives. Each knife block has a mounting portion 62 which is securely fastened to a knife mounting bar 64 secured to a plurality of spaced apart rocker arms 66 clamped about an oscillating rocker shaft 68, the shaft 68 being journalled in bearings carried by respective bearing housings 70 fastened to cross members 71 formed in the bed casting. Oscillation of the shaft 68 results in the knives 58 forcibly engaging the cutting edges of the respective hooks as the knives and the hooks oscillate so as to cut loops of yarn on the hooks in scissors-like fashion as well known in the tufting art.

To effect oscillation of the hook drive link 56, the end of the link 56 remote from the hook bar 54 is journally mounted about a journal pin 72. Also journally mounted on the pin 72 are the bifurcated arms of a rocker member 74, the rocker being clamped about an oscillating rock shaft 76 which together with the knife rock shaft 68 is driven at least one end of the tufting machine from the main shaft 36 and thus in timed relationship with the needles 28. In order to support the hook bar 54 and the links 56 to prevent them from uncontrollably pivoting about the pin 72, the present invention provides a resilient means in the form of a plurality of leaf springs 78, the springs 78 being fastened to the hook bar by screws 80 with a spacer 82 between the springs and the hook bar. The other ends of the plurality of springs 78 are secured to a support rail 84 by screws 86 with a spacer 88 between the springs and the rail 84. The support rail 84 is in turn securely fastened to U-shaped brackets 90 secured at each end of a respective bearing housing 70 so that the rail is fixed in the bed.

Accordingly, as the rock shaft 76 oscillates, the hooks 48 oscillate in a to and fro motion relative to the path of reciprocation of the needles so that each hook may seize a loop from a respective needle. Additionally, the knives 58 oscillate relative to the hooks, each knife acting against a face of a respective hook so as to cut a loop thereon in scissors-like fashion. Thus, the knives apply a lateral force to the hooks which may only be minimally counteracted by the low mass leaf spring. In the prior art, the long rigid heavy rocker arm provided the lateral support. Thus, the leaf springs, which effect a low oscillating mass, must be supplemented to provide sufficient lateral support to counteract the knife load.

Figure 3:
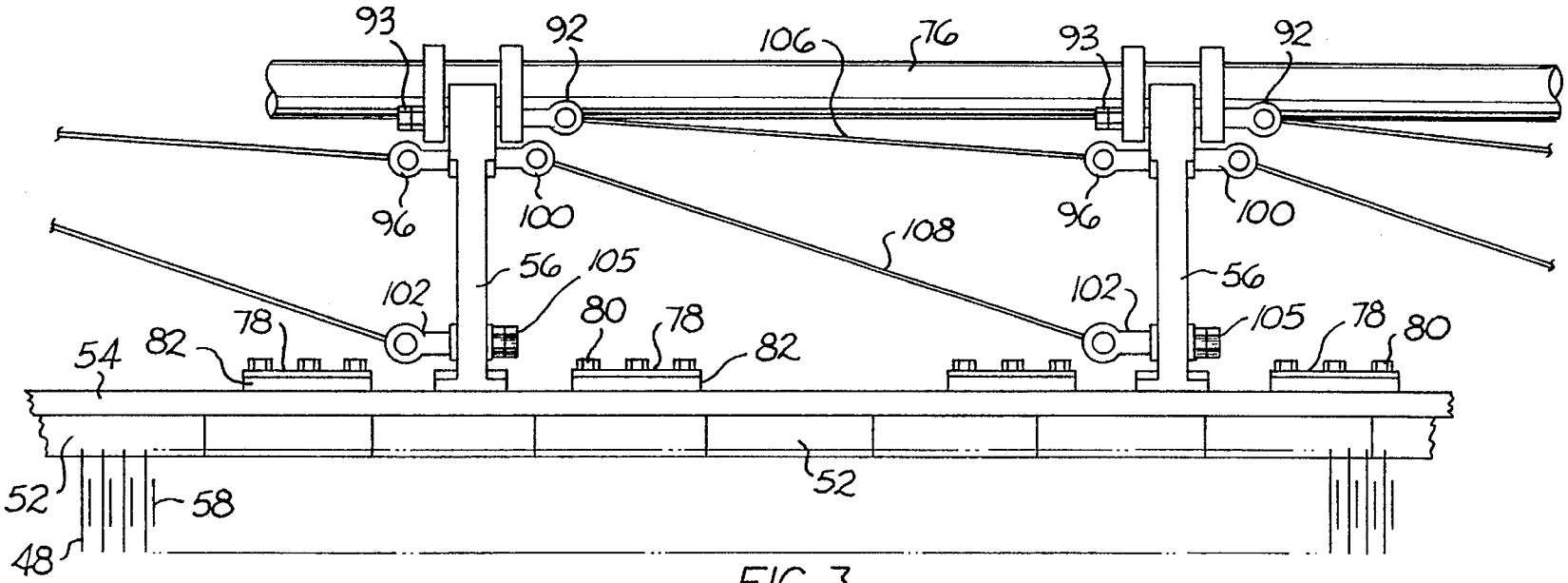
FIG. 3 is a top plan view of a section of the hook drive system with portions of the bed of the tufting machine removed for clarity.
Figure 4:
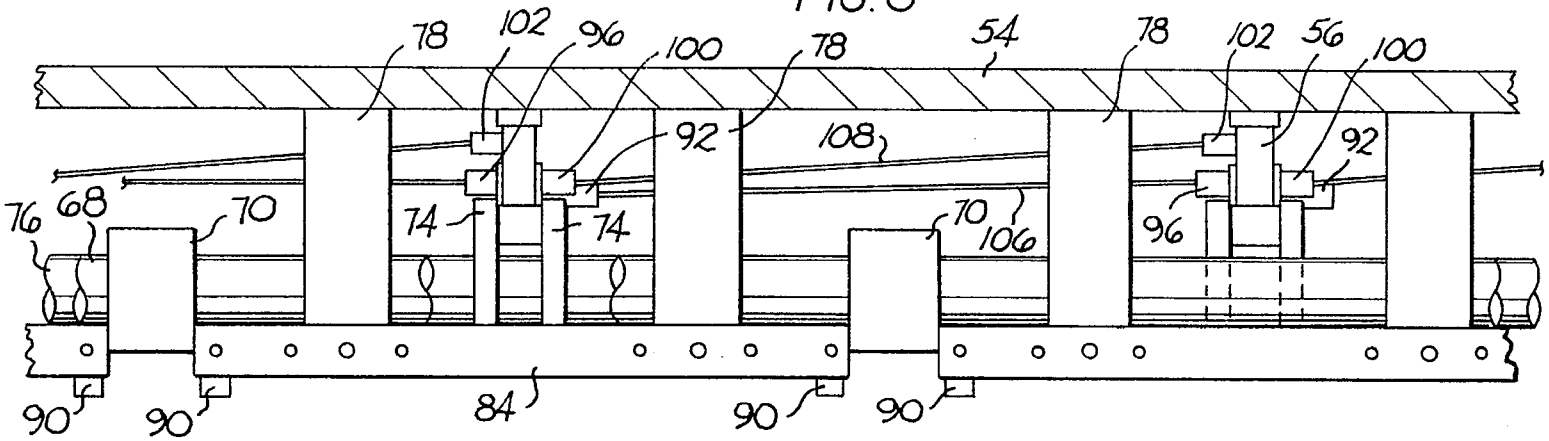
FIG. 4 is a cross sectional view taken substantially along line 4—4 of FIG. 2.

To counteract the lateral forces on the hooks, the present invention provides cables or tie-rods which extend laterally between adjacent links 56. The links 56 include a first clevise 92 secured to a pin 94 journalled within the journal pin 72 and adjustably secured therein by threaded nut means 93 on the end of the pin 94 remote from the clevise, the clevise extending relative to the link 56 in the direction of the load applied by the knives to the hooks. Thus, as illustrated in FIG. 3, the clevise extends from the right side and the load applied by the knives against the hooks is directed toward the right. The links also include another clevise 96 extending from the opposite side of the link from the clevise 92 and spaced from the clevise 92 and the pin 94. The clevise 96 is mounted on a common pin 98 with a third clevise 100 which extends in the opposite direction to the clevise 96 and thus the same direction as the clevise 92, the pin 98 being journalled in the link 56. Additionally, there is provided another clevise 102 mounted on a pin 104 journalled in the link 56 adjacent the hook bar 54 and adjustably secured by threaded nut means 105, the clevise 102 extending from the link 56 in the same direction as the clevise 96. A cable or tie-rod 106 extends through the eyes of the clevises 92 and 96 of adjacent links to laterally support the link on which the clevise 92 is disposed adjacent the end remote from the hook bar, while a similar cable or tie-rod 108 extends through the eyes of the clevises 100 and 102 of the adjacent links to laterally support the link on which the clevise 102 is disposed adjacent the hook bar end. The tie-rods thus extend at an inclination between the adjacent links. Accordingly the knife load on the hooks is transferred from the resiliently supported ends toward the rigidly supported end of the adjacent link and directed oppositely to that of the knife load.

It should thus be clear that the present invention provides a low oscillating mass hook drive system for cut pile tufting machines, whereby the speed of the machine may be increased relative to that of the prior art.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. In a tufting machine having a bed, a plurality of laterally spaced hooks for seizing loops of yarn presented thereto, a laterally extending oscillating shaft mounted in the bed, a plurality of rocker arms fastened to said shaft for oscillating therewith, a link having a first end pivotally journalled on each rocker arm and a second end, and means including a hook bar for securing said hooks to said second end of said links, the improvement comprising: resilient means having a first end fixed in said bed and a second end, and means for securing said second end of said resilient means to said hook bar, said resilient means flexing as said hooks rock in response to oscillation of said rocker arms.

2. In a tufting machine as recited in claim 1, wherein said resilient means comprises a plurality of laterally spaced apart leaf springs.

3. In a tufting machine as recited in claim 1, including a knife corresponding to each hook for acting against a surface of the respective hook, means for oscillating each knife to provide a scissors-like cutting action with the respective hook to cut loops of yarn seized by the hooks and thereby apply a lateral force against each hook, said tufting machine including force transferring means extending between and attached to adjacent links for counteracting the lateral force.

4. In a tufting machine as recited in claim 3, wherein said force transferring means comprises at least one tie-rod.

5. In a tufting machine as recited in claim 3, wherein said force transferring means comprises a plurality of tie-rods.

6. In a tufting machine as recited in claim 5, wherein said tie-rods extend at an inclination between said adjacent links.

7. In a tufting machine as recited in claim 3, wherein said force transferring means comprises at least one tie-rod extending from one link adjacent said hook bar to an adjacent link adjacent said rocker arm.

8. In a tufting machine as recited in claim 7, wherein said tie-rod extends at an inclination between said adjacent links.

9. In a tufting machine as recited in claim 2, including a knife corresponding to each hook for acting against a surface of the respective hook, means for oscillating each knife to provide a scissors-like cutting action with the respective hook to cut loops of yarn seized by the hooks and thereby apply a lateral force against each hook, said tufting machine including force transferring means extending between and attached to adjacent links for counteracting the lateral force.

10. In a tufting machine as recited in claim 9, wherein said force transferring means comprises at least one tie-rod.

11. In a tufting machine as recited in claim 9, wherein said force transferring means comprises a plurality of tie-rods.

12. In a tufting machine as recited in claim 11, wherein said tie-rods extend at an inclination between said adjacent links.

13. In a tufting machine as recited in claim 9, wherein said force transferring means comprises at least one tie-rod extending from one link adjacent said hook bar to an adjacent link adjacent said rocker arm.

14. In a tufting machine as recited in claim 13, wherein said tie rod extends at an inclination between said adjacent links.

* * * * *